US010235977B1

(12) United States Patent
Davis

(10) Patent No.: US 10,235,977 B1
(45) Date of Patent: Mar. 19, 2019

(54) STRING INSTRUMENT PICKING SYSTEM

(71) Applicant: Terry Davis, Plano, TX (US)

(72) Inventor: Terry Davis, Plano, TX (US)

( * ) Notice: Subject to any disclaimer, the term of this patent is extended or adjusted under 35 U.S.C. 154(b) by 0 days.

(21) Appl. No.: 15/682,866

(22) Filed: Aug. 22, 2017

Related U.S. Application Data

(60) Provisional application No. 62/378,762, filed on Aug. 24, 2016.

(51) Int. Cl.
*G10D 3/16* (2006.01)

(52) U.S. Cl.
CPC ..... *G10D 3/163* (2013.01)

(58) Field of Classification Search
USPC ..... 84/322
See application file for complete search history.

(56) References Cited

U.S. PATENT DOCUMENTS 3,648,558 A * 3/1972 Chenette ..... G10D 3/163 84/322
4,177,698 A * 12/1979 Greneker ..... A61B 17/3211 294/25
4,467,873 A * 8/1984 Kaatz ..... B26B 27/007 172/370
5,806,091 A * 9/1998 McHugh ..... A41D 13/082 2/20
6,127,613 A * 10/2000 Hansel ..... G10D 3/163 84/320
6,891,095 B2 * 5/2005 Charters ..... G10D 3/163 84/320
6,977,330 B2 * 12/2005 Santa Cruz ..... G10D 3/163 84/320
7,589,267 B1 * 9/2009 Sims ..... G10D 3/163 84/320
2009/0056521 A1 * 3/2009 Goad ..... G10D 3/163 84/320
2011/0079131 A1 * 4/2011 Broderick ..... G10D 3/163 84/329
2014/0076120 A1 * 3/2014 Hollin, Jr. ..... G10D 3/163 84/322
2015/0243264 A1 * 8/2015 Parker ..... G10D 3/163 84/322

* cited by examiner

*Primary Examiner* — Christopher Uhlir
(74) *Attorney, Agent, or Firm* — Eldredge Law Firm, LLC; Richard Eldredge; Beth Felix

(57) ABSTRACT

A guitar picking device includes a first securement body, having a first lip to secure around a first finger; a second securement body, having a second lip to secure around a second finger; and a guitar pick secured between the first securement body and the second securement body; the guitar pick faces away from a user's knuckles when the first securement body and the second securement body are secured around the first and second finger.

6 Claims, 6 Drawing Sheets

STRING INSTRUMENT PICKING SYSTEM

BACKGROUND

1. Field of the Invention

The present invention relates generally to instrument systems, and more specifically, to a string instrument picking system for improved grip and control.

2. Description of Related Art

Instrument systems are well known in the art and are effective means to play music. For example, FIG. 1 depicts a conventional string picking system 101 having a user 103, a guitar pick 105, and guitar strings 107. During use, the user 103 holds the pick 105 and strums or picks the guitar strings 107.

One of the problems commonly associated with system 101 is insufficient control and coordination. For example, the user 103 may drop or lose control of the pick 105, causing an inconvenience while strumming the guitar strings 107.

Accordingly, although great strides have been made in the area of string instrument picking systems, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
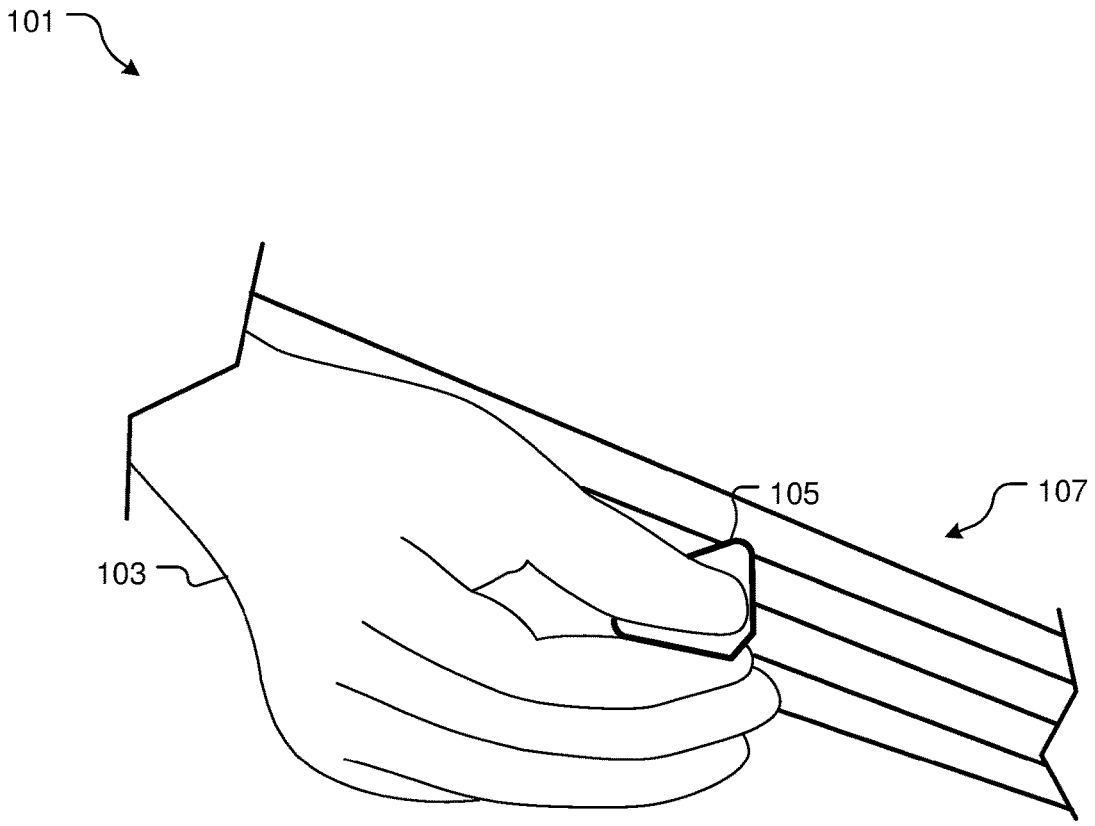
FIG. 1 (Prior Art)
FIG. 1 is an oblique view of a common string instrument picking system.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional string instrument picking system. Specifically, the system of the present invention improves coordination and control during the strumming of a string instrument. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Figure 2:
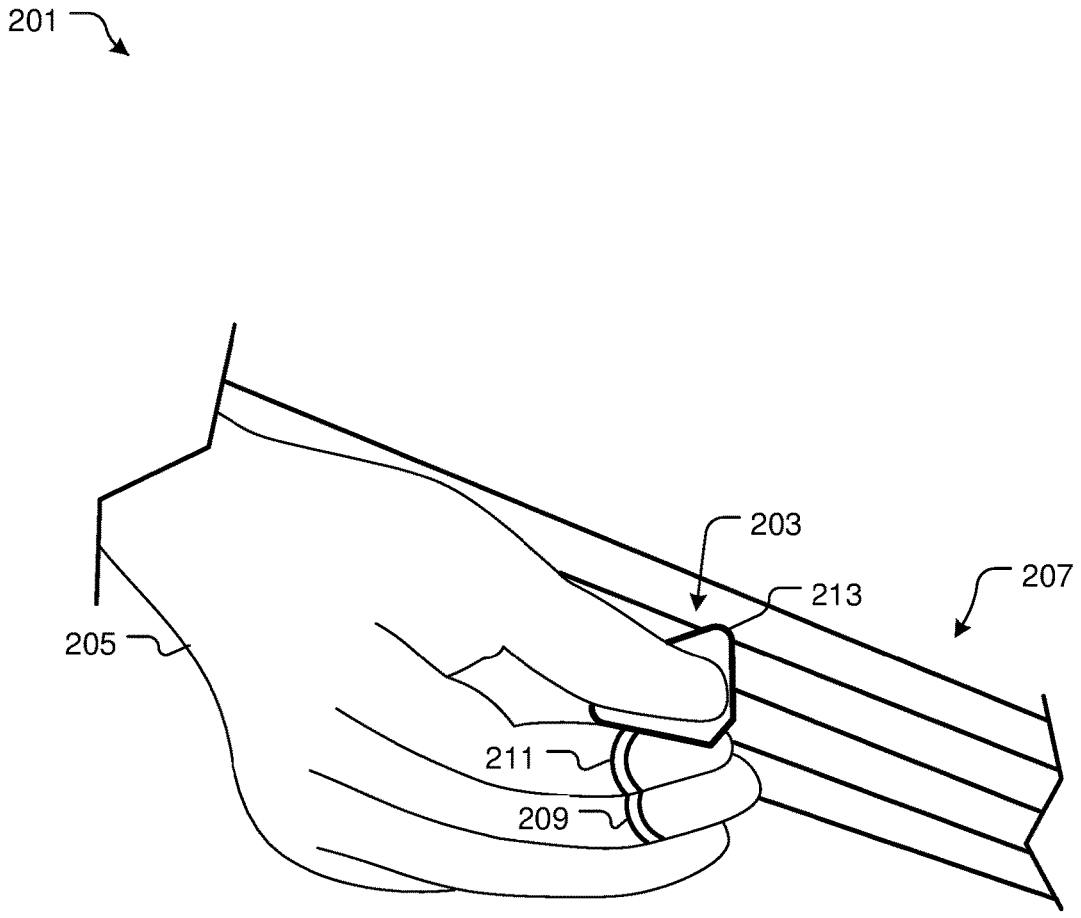
FIG. 2 is an oblique view of a string instrument picking system in accordance with a preferred embodiment of the present application.

Referring now to the drawings wherein like reference characters identify corresponding or similar elements throughout the several views, FIG. 2 depicts a top view of a string instrument picking system in accordance with a preferred embodiment of the present application. It will be appreciated that system 201 overcomes one or more of the above-listed problems commonly associated with conventional instrument picking systems.

In the contemplated embodiment, system 201 includes a picking device 203 in communication with the user's hand 205 and in communication with strings 207 of a string instrument. In the contemplated embodiment, the picking device 203 comprises a first ring 209, a second ring 211, and a pick 213 in communication with the second ring 211, wherein the first ring 209 and second ring 211 are configured to engage the fingers of the user's hand 205 to increase stability and control of the pick 213 during use. It should be appreciated that the rings can vary in size and material as desired for aesthetical, functional, or manufacturing considerations.

Figure 3:
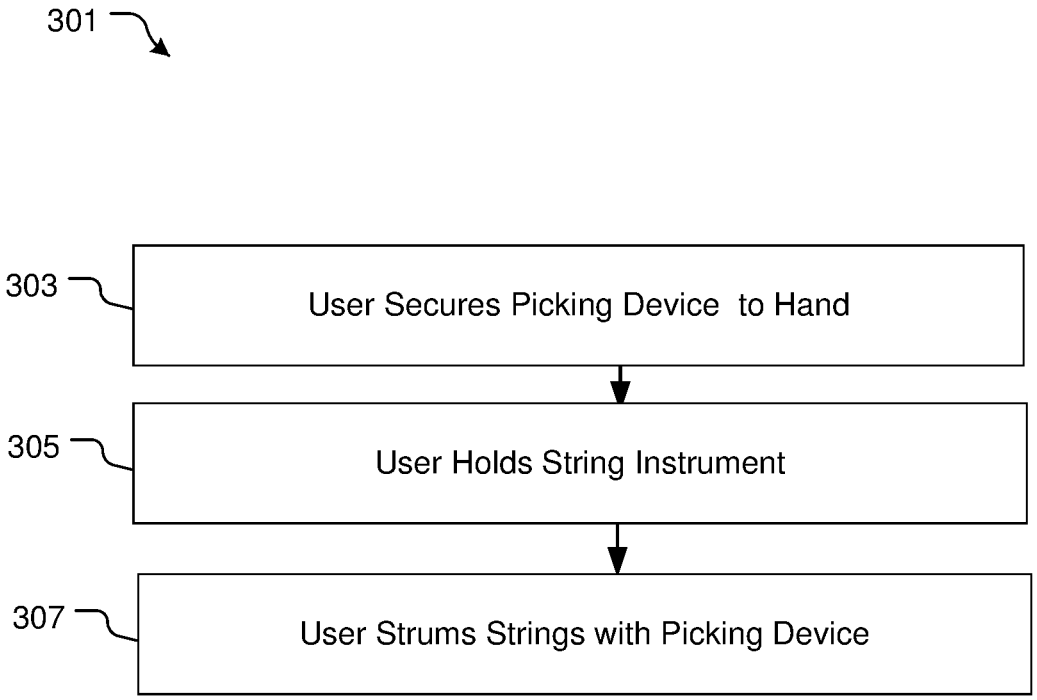
FIG. 3 is a flowchart depicting the method of use of a string instrument picking system in accordance with a preferred embodiment of the present application.

As shown in FIG. 3, a flowchart 301, depicts the method of use of system 201. The user secures the picking device 203 to their hand 205, securely holds the string instrument, and strums the strings 207 with the picking device 203, as shown with boxes 303, 305, and 307.

Figure 4:
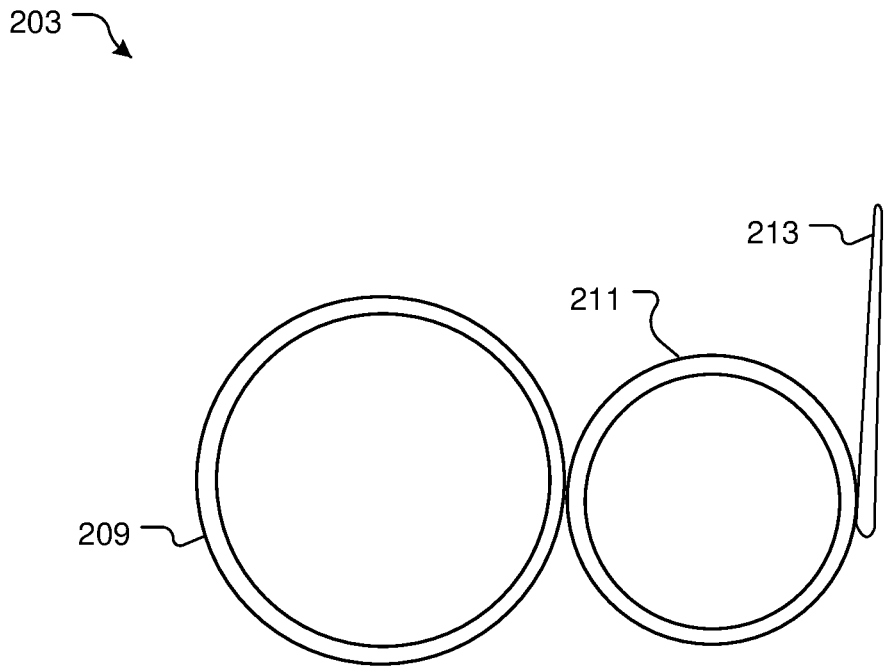
FIG. 4 is a top view of the picking device of the string instrument picking system in accordance with a preferred embodiment of the present application.

FIG. 4 is a top view of the picking device 203 from system 201. The picking device 203 comprises a first ring 209 in communication with a second ring 211 and a pick 213 in communication with the second ring 211.

Figure 5:
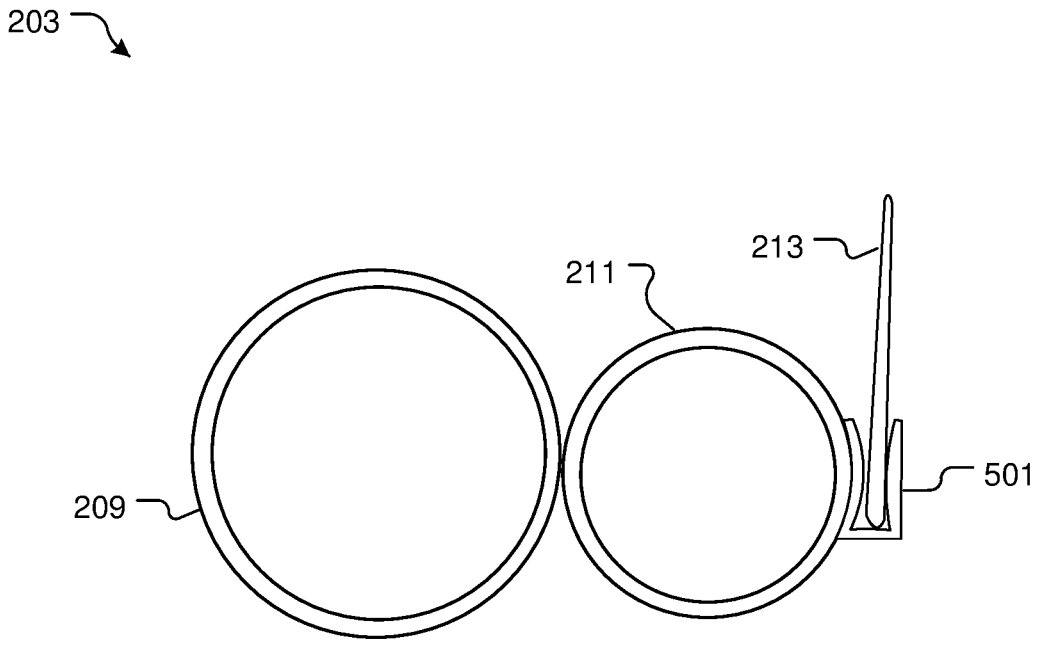
FIG. 5 is a top view of an alternative embodiment of the picking device of the string instrument picking system of the present application.

In FIG. 5, an alternative embodiment of the picking device 203 is shown wherein the picking device 203 further includes a pick holder 501, allowing the user to interchange the pick 213.

Figure 6:
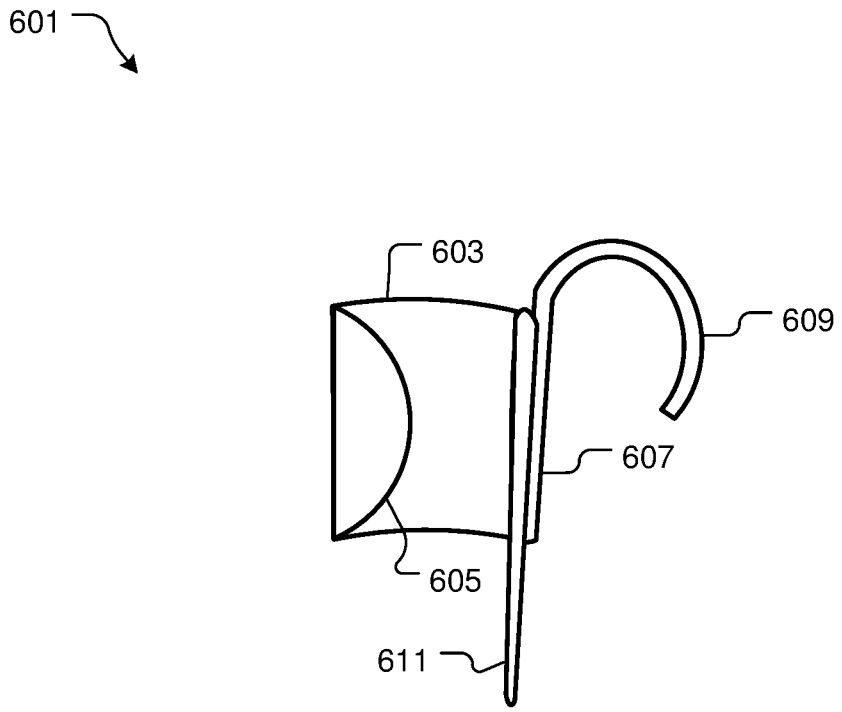
FIG. 6 is a top view of a second alternative embodiment of the picking device of the string instrument picking system of the present application.

In FIG. 6, an alternative embodiment of a picking device 601 is shown, having a first finger securement body 603 having a lip 605 configured to wrap around the user's index finger. Device 601 further includes a second finger securement body 607 with a lip 609 configured to wrap around the user's thumb. A pick 611 is positioned between the body 603 and body 607 and configured to be used to pick the strings of the device. It should be appreciated that bodies 603 and 607 can be composed of a rigid material such as plastic, or composed of a flexible material, such as rubber.

It should be appreciated that one of the unique features believed characteristic of the present application is the combination of multiple finger rings, which allow for improve control and coordination of the pick.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A guitar picking device, comprising:

a first securement body, having:

a first body portion to wrap partially around a first finger of a user;

a first lip integrally attached to the first body portion and curved so as to hold the body portion in place around the first finger;

wherein the first securement body only partially surrounds the first finger a second securement body attached to the first securement body and having:

a second body portion to wrap partially around a second finger of the user, the second body extending perpendicular to the first body portion;

a second lip integrally attached to the second body portion and curved so as to hold the second body portion in place around the second finger; and a guitar pick secured between the first securement body and the second securement body and extending away from the first securement body and the second securement body away from the second lip;

wherein the guitar pick faces away from a user's knuckles when the first securement body and the second securement body are secured around the first and second finger.

2. The guitar picking device of claim 1, wherein the first securement body and the second securement body are composed of a flexible material.

3. The guitar picking device of claim 1, wherein the first securement body and the second securement body are composed of a rigid material.

4. A guitar picking device, comprising:

a first open ring configured to secure to a first finger, the first open ring being circular;

a second open ring configured to secure to a second finger, the second open ring being circular;

the first open ring and second open ring being attached; and a pick secured to the second ring opposite the first ring;

wherein the first finger passes completely through the first open ring;

wherein the second finger passes completely through the second open ring; and wherein the pick is configured to extend away from a user's knuckles when the guitar picking device is secured to first finger and the second finger.

5. A guitar picking device of claim 4, wherein the pick is removably secured to the second ring via a pick holder rigidly secured to the second ring.

6. A method of picking a guitar, comprising:

providing the guitar picking device of claim 1;

securing the picking device to the first finger and the second finger; and strumming the guitar with the guitar picking device.

* * * * *